US005340032A

United States Patent [19]

Stegmaier et al.

[11] Patent Number: 5,340,032

[45] Date of Patent: Aug. 23, 1994

[54] ELECTROMAGNETICALLY OPERATED INJECTION VALVE WITH A FUEL FILTER THAT SETS A SPRING FORCE

[75] Inventors: Alwin Stegmaier; Kenneth Tanski, both of North Charleston, S.C.

[73] Assignee: Robert Bosch GmbH, Stuttgart, Fed. Rep. of Germany

[21] Appl. No.: 64,028

[22] PCT Filed: Sep. 2, 1992

[86] PCT No.: PCT/DE92/00726

§ 371 Date: May 19, 1993

§ 102(e) Date: May 19, 1993

[87] PCT Pub. No.: WO93/06359

PCT Pub. Date: Apr. 1, 1993

[30] Foreign Application Priority Data

Sep. 21, 1991 [DE] Fed. Rep. of Germany ..... 4131535

[51] Int. Cl.[5] ..... F02M 51/06; F02M 57/00; F02M 61/20; F02M 37/22

[52] U.S. Cl. ..... 239/575; 239/585.1; 239/900; 251/129.18; 251/129.21; 210/171; 210/429; 210/432

[58] Field of Search ..... 239/575, 585.1–585.5, 239/900, DIG. 23; 251/129.18, 129.21; 210/171, 416.4, 429, 432, 448

[56] References Cited

U.S. PATENT DOCUMENTS

| | | | |
|---|---|---|---|
| 4,385,339 | 5/1983 | Takada et al. | 251/129.21 |
| 4,575,009 | 3/1986 | Giraudi | 239/585.4 |
| 4,625,919 | 12/1986 | Soma et al. | 239/585.4 |
| 4,717,080 | 1/1988 | Sauer | 239/585.4 |
| 4,944,486 | 7/1990 | Babitzka | 239/585.4 |
| 4,946,107 | 8/1990 | Hunt | 251/129.21 |
| 5,190,221 | 3/1993 | Reiter | 239/585.1 |

*Primary Examiner*—Karen B. Merritt

*Attorney, Agent, or Firm*—Edwin E. Greigg; Ronald E. Griegg

[57] ABSTRACT

An electromagnetically operated injection valve including a fuel filter that has a filter housing on which a return spring is supported and which includes a frame that is pressed into a flow hole so that the force introduced by the return spring onto the fuel filter is guided via the filter housing and the frame pressed into the core. This obviates the need for a setting bushing for setting the spring force. The injection valve is particularly suitable for fuel injection units of mixture compressing spark ignited internal combustion engines.

9 Claims, 3 Drawing Sheets

ELECTROMAGNETICALLY OPERATED INJECTION VALVE WITH A FUEL FILTER THAT SETS A SPRING FORCE

PRIOR ART

The invention is based on an electromagnetically operated injection valve as set forth hereinafter. From the DE-OS 33 06 304, an injection valve is known, in which a fuel filter, consisting of a frame and a filter element, is arranged at the upstream end of a core flow hole which is designed to be concentric with the longitudinal axis of the valve. The filter element has a fine mesh and a supporting housing which partially encloses the mesh. The fuel filter retains fine contaminants, which would otherwise block the injection orifices in the region of a valve closing body.

Downstream from the fuel filter, a setting bushing is pressed into the flow hole of the core. At the end facing the valve closing body, the setting bushing has a contacting front face which extends at right angles to the longitudinal axis of the valve, on which a return spring is supported. The setting bush is used for setting the force of the return spring which acts on the valve closing body. The spring force is dependent on the depth to which the setting bush is pressed into the flow hole of the core.

The filtration of the fuel and the setting of the spring force are thus effected by two separate components, whereby the labour involved in mounting and the material expenditure with the resulting production costs is considerably increased. Moreover, it is not possible to alter the force of the return spring without first removing the fuel filter from the flow hole.

ADVANTAGES OF THE INVENTION

In contrast, the electromagnetically operated injection valve in accordance with the invention has the advantage that the filtration of the fuel and the setting of the spring force is effected by a single component, thereby considerably reducing the production effort relative to the prior art in a simple manner, and consequently lowering the production costs significantly. Furthermore, the force of the return spring can be set without other components of the valve having to be dismantled.

The measures listed herein facilitate advantageous developments and improvements of the injection valve specified hereinafter. A pot-shaped design of the filter element facilitates the extension of the surface through which the medium flows, opposite the flat disc-shaped filter element which is arranged across the flow direction, whereby the filter life is prolonged.

The use of nylon for the filter housing ensures high component rigidity, whereby the distortion of the housing is reduced to a minimum and the force of the return spring is kept constant.

The use of non-corroding metal for the frame of the fuel filter prevents corrosion on the surfaces of the press seat between the frame and the core.

Due to the design of an extension which is arranged on the end of the fuel filter which faces the injection orifice and which is at least partly in contact with the wall of a flow hole, the position of the fuel filter is stabilised.

DRAWING

Embodiment examples of the invention are shown simplified in the drawing and are more closely explained in the description which follows.

FIG. 1 shows a first example of a fuel injection valve designed in accordance with the invention, FIG. 2 shows a fuel filter in accordance with the invention in an enlarged representation, FIG. 3 shows a second embodiment example of an injection valve designed in accordance with the invention.

DESCRIPTION OF THE EMBODIMENT EXAMPLES

Figure 1:
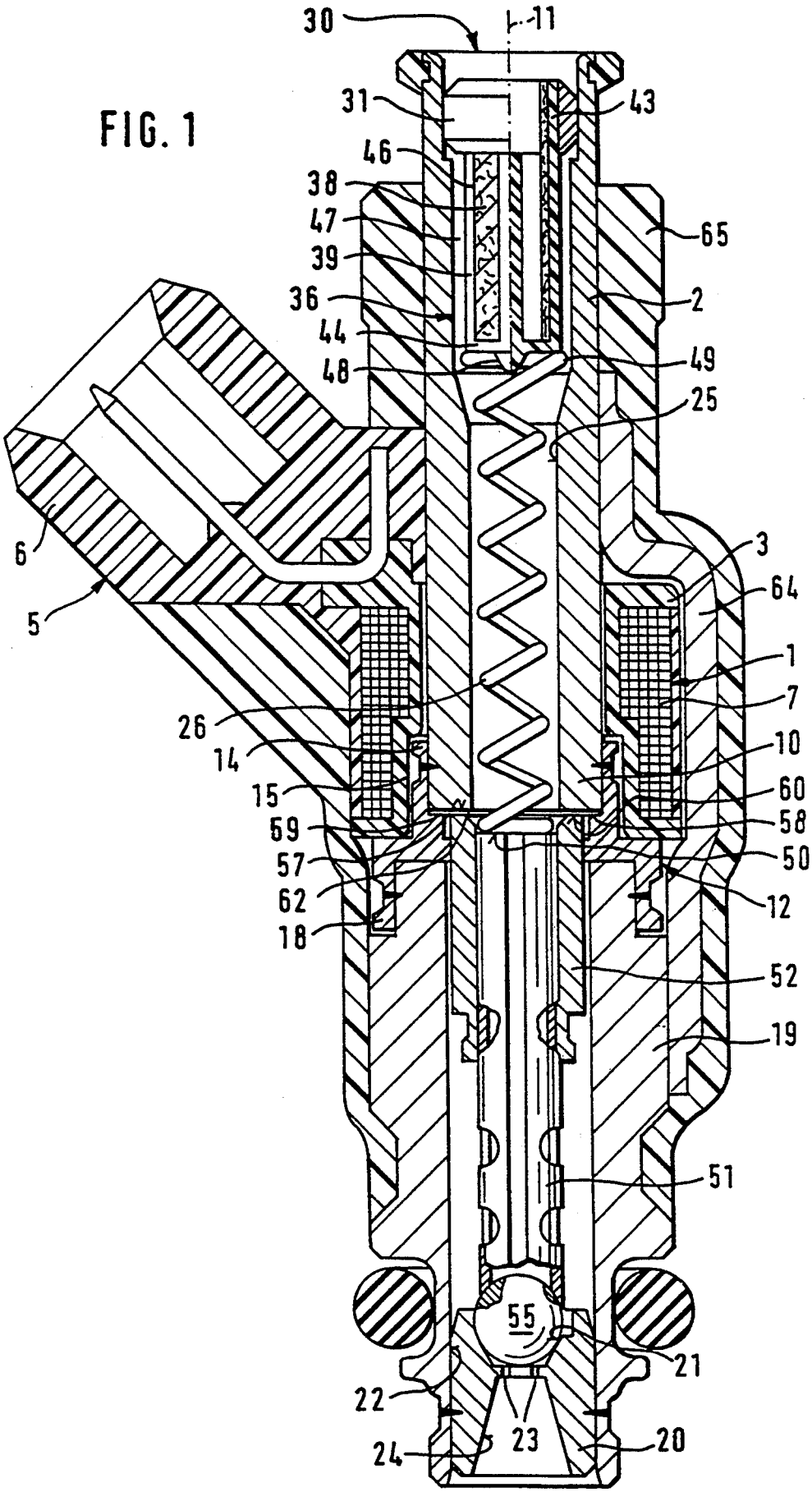

The injection valve, shown as an example in FIG. 1 of the drawing, for fuel injection units of a mixture compressing spark ignited internal combustion engine has a core 2 which is surrounded by the magnetic coil 1 and which is used as a fuel filler neck. The magnetic coil 1 with a coil body 3 is provided with a plastic moulding 5, which has an electrical connection plug 6 integrally moulded onto it. The coil body 3 of the magnetic coil 1 which is radially stepped carries windings 7, which are also radially stepped. A tubular metallic intermediate part 12 is connected to the lower core end 10, concentric with the valve's longitudinal axis 11 of the core 2, by welding, and partially covers the core end 10 axially with an upper cylinder section 14. The stepped coil body 3 includes an upper portion that overlaps the core 2 and a larger diameter portion 15 that overlaps an upper portion 14 of the intermediate part 12. At the end facing away from the core 2, the intermediate part 12 is provided with a lower cylinder section 18 which overlaps a tubular jet carrier 19, to which it is sealed, for example by welding. A cylindrical valve seat body 20 is sealed by welding into the downstream end of the jet carrier 19, in a through-hole 22 which extends concentrically with the valve's longitudinal axis 11. The valve seat body 20 has a fixed valve seat 21 facing the magnetic coil 1, downstream from which two injection orifices 23 are provided in the valve seat body 20. Downstream from the injection orifices 23, the valve seat body 20 has a processing hole 24 which expands in the flow direction in the manner of a truncated cone.

Figure 2:
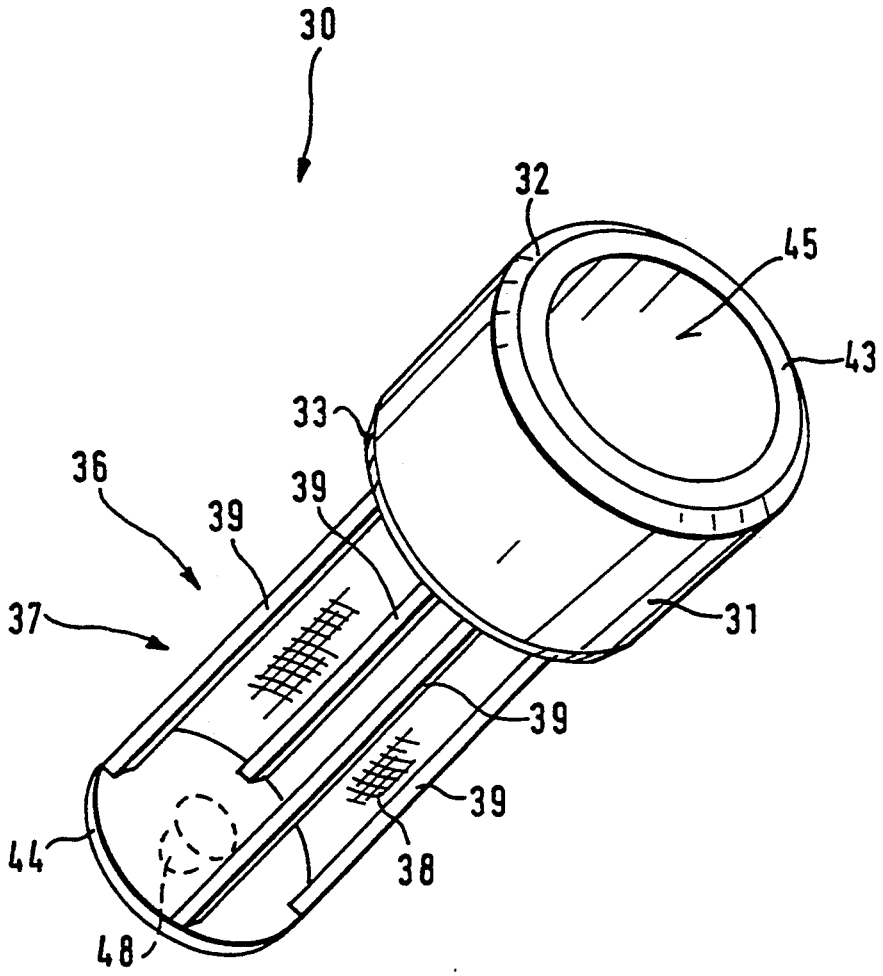

A fuel filter 30 is pressed into the flow hole 25 of the core 2, which extends concentrically with the longitudinal axis 11 of the valve, which filter retains fine floating particles from the fuel which flows through it, and via whose axial position in the flow hole 25, i.e. via a more or less deep insertion into the flow hole 25, the force of a return spring 26, arranged in the flow hole 25, can be set. FIG. 2 shows an enlarged view of the fuel filter 30. A frame 31 of the fuel filter 30 is designed as a non-corrodible metal bushing, e.g. brass, which has a slightly larger outside diameter than the flow hole 25 and is held in by a press-fit. Due to the two chamfers 32, 33, which are arranged on the outside of the frame 31 at each end of the frame, the insertion of the fuel filter 30 into the flow bore 25 is made easier, and which at the same time prevents the surface of the flow hole 25 from being scratched during assembly, and also prevents any incidental fragments from impairing the function of the injection valve.

Following on downstream from the frame 31 is a filter element 36 of a pot-shaped design, connected with the frame, which consists of a cage-type filter housing 37 and a fine mesh 38. The mesh 38 rests against the inner side of the filter housing 37 on which it is supported. The filter housing 37 is composed of several—for example, four—evenly distributed, slim, bar-shaped legs 39, which lie parallel to the longitudinal axis 11 of the valve and which are followed by a disc 44 extending radially on the end which faces the return spring 26. Alternatively, the legs may extend in such a manner that they touch the wall of the flow hole 25 so that they also contribute to the radial guidance and thus to the coaxial alignment of the fuel filter 30 in the flow hole 25. The fuel emerging from the mesh 38 can flow between the legs 39, past the disc 44, and onwards in an axial direction to the injection orifice 23. Alternatively, the legs may, as previously mentioned and shown in FIG. 1, extend at a radial distance from the wall of the flow hole 25. At the end of the bars 39, facing away from the disc 44, there is a tubular section 43 with an orifice 45, this section has a larger external diameter than the internal diameter of the frame 31, and is pressed into it.

All the fuel flows through the orifice 45 into the filter element 36, from where the fuel enters through a surface area 46 of the mesh 38 into an annular space 47, which is formed by the mesh 38 and the wall of the flow hole 25. From the annular space 47, the fuel flows on in the flow hole 25 in the direction of the injection orifices 23.

At the end of the filter facing the valve seat 21, the disc 44 has an end extension 48 which lies concentric with the longitudinal axis 11 of the valve. The end extension serves as a guide for the return spring 26 and engages axially the return spring 26 at least in the upstream end of the first coil 49 of the spring. The axial force introduced by the return spring 26 into the filter housing 37 may, in certain circumstances, lead to deformations, e.g. to buckling of the bars 39. The resulting change of length of the filter housing 37 leads to an alteration of the force of the return spring 26. In order to reduce this deformation to the minimum, the filter housing 37 is designed as stable as possible and this is achieved by selecting a suitable material, for example reinforced nylon.

Figure 3:
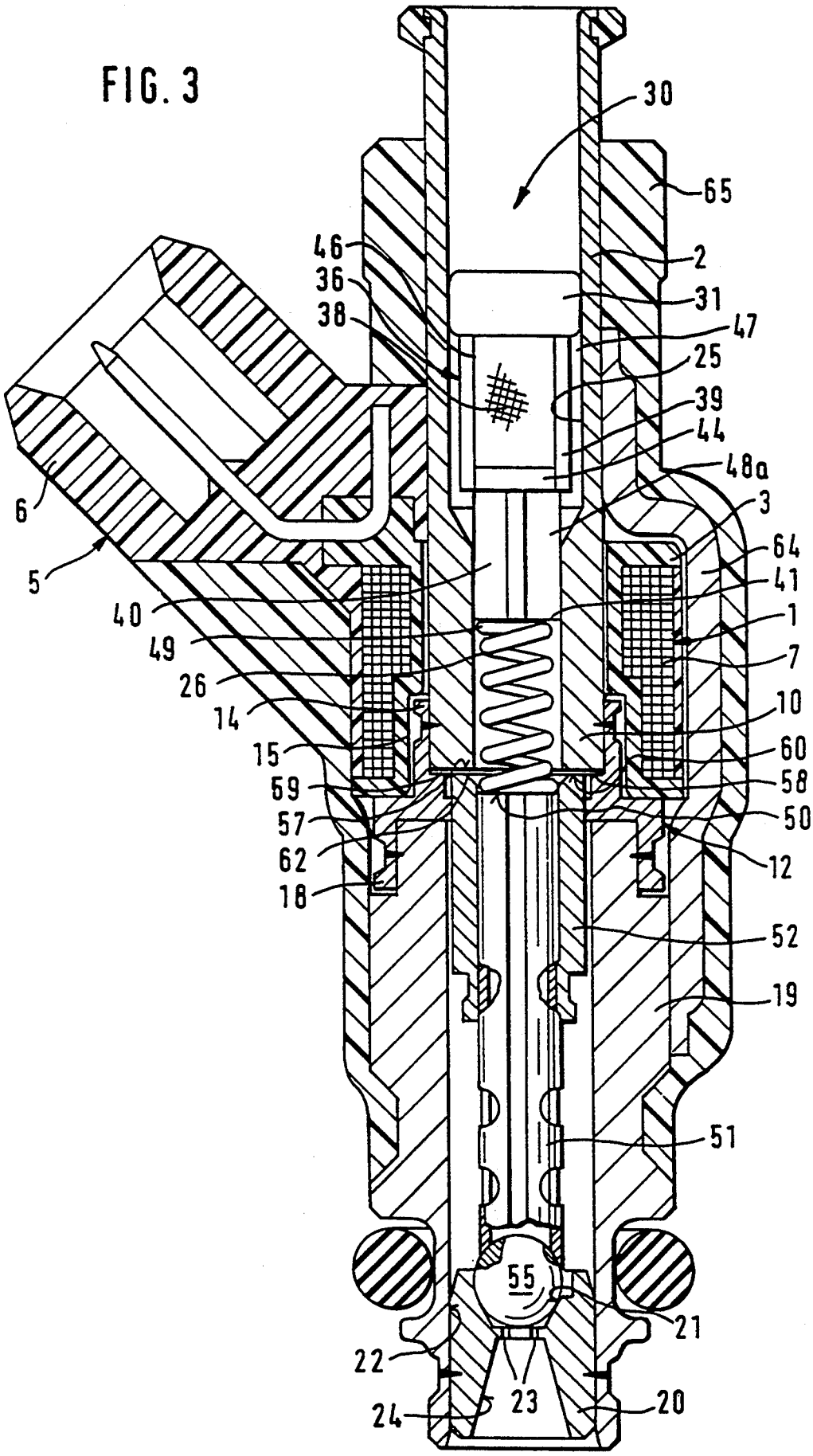

FIG. 3 of the drawing shows a second embodiment example of an injection valve designed in accordance with the invention, with the fuel filter in accordance with the invention. Components which remain the same as those in the embodiment example shown in FIGS. 1 and 2, and components of the same action are identified by the same reference symbols. Compared to the embodiment example in FIGS. 1 and 2, the fuel filter 30 has an elongated end extension **48*a* which extends further in the axial direction and which has, for example, a cross-shaped cross-section with four longitudinal recesses 40 and which rests partly on the wall of the flow hole 25. The return spring 26 is supported on a contacting front face 41, of the elongated end extension 48*a*, which faces the injection orifices 23. The fuel flows in the longitudinal recesses 40 between the wall of the flow hole 25 and the spigot 48*a* in the direction of the injection orifices 23**.

The depth to which the fuel filter 30 is pressed into the flow hole 25 of the core 2 determines the force of the return spring 26, thereby also influencing the dynamic amount of fuel delivered during the opening and closing stroke of tile injection valve. The return spring 26 is supported by the end which faces away from the fuel filter 30, in the downstream direction, on a front face 50 of a connection pipe 51. A tubular armature 52 is connected with that end of the connection pipe 51 which faces the return spring 26, for example, by means of welding. A valve closing body 55, for example of spherical shape, is connected, for example, by welding, to the connection pipe 51 at the upper end of the valve closing body, this valve closing body acts in conjunction with the valve seat 21 of the valve seat body 20.

Between a front face 57 of the core end 10 which faces the armature 52, and a shoulder 58, which leads to the upper cylinder section 14, of the intermediate part 12, an axial gap 59 is provided, in which—forming a residual air gap between a supply side front face 60 of the armature 52 and the front face 57 of the core end 10—a non-magnetic stop disc 62 is clamped in position, which limits the stroke of the valve closing member 55 during the opening action of the valve.

The magnetic coil 1 is at least partially surrounded by at least one conductive element 64 which is designed as a stirrup and which serves as a ferromagnetic element and which rests with one end on the core 2 and with the other end on the jet support 19 to which it is connected by welding or soldering.

A part of the valve is enclosed by a plastic casing 65 which, starting from the core 2, extends in an axial direction via the magnetic coil 1 with the connection plug 6 and the at least one conductive element 64.

We claim:

1. An electromagnetically operated injection valve for fuel injection units of internal combustion engines, comprising a metal core extending along a longitudinal axis of a valve, and a flow hole in the metal core in which a fuel filter is press-fitted, a magnetic coil and an armature, through which a valve closing body, acting in conjunction with a fixed valve seat is operated, a return spring arranged concentrically in relation to the longitudinal axis of the valve and which acts on the valve closing body, the return spring (26) is supported at one end by and at an end of the fuel filter (30) which faces toward the valve closing body (55) so that the depth to which the fuel filter is pressed into said flow hole determines the force of the return spring.

2. An injection valve in accordance with claim 1, in which the fuel filter (30) comprises a filter element (36) and a frame (31) to which the filter element is connected.

3. An injection valve in accordance with claim 2, in which the frame (31) is designed as a bushing and has a larger external diameter than the flow hole (25).

4. An injection valve in accordance with claim 3, in which the frame (31) of the fuel filter (30) comprises a non-corrodible metal.

5. An injection valve in accordance with claim 3, in which the filter element (36) is pot-shaped and comprises a filter housing (37) and a fine mesh (38).

6. An injection valve in accordance with claim 5, in which the filter housing (37) is of nylon.

7. An injection valve in accordance with claim 5, in which the filter housing (37) has an end extension (48, **48*a*) on an end which faces the valve closing body (55**).

8. An injection valve in accordance with claim 7, in which the end extension (48) of the filter housing (37) projects into at least one coil of the return spring (26).

9. An injection valve in accordance with claim 7, in which the filter housing (37) includes a circumference at least partially in contact with the wall of the flow hole (25) and with at least one longitudinal recess (40) extending in the direction of the longitudinal axis (11) of the valve, and a contacting front face (41) facing the return spring (26) which is engaged by the return spring (26).

* * * * *